US009741329B2

(12) United States Patent
Bochmann

(10) Patent No.: US 9,741,329 B2
(45) Date of Patent: Aug. 22, 2017

(54) METHOD FOR THE SYNTHETIC GENERATION OF A DIGITAL AUDIO SIGNAL

(71) Applicant: JoboMusic AG, Kastanienbaum (CH)

(72) Inventor: Johannes Bochmann, Berlin (DE)

(73) Assignee: JoboMusic AG (CH)

( * ) Notice: Subject to any disclaimer, the term of this patent is extended or adjusted under 35 U.S.C. 154(b) by 0 days.

(21) Appl. No.: 15/117,898

(22) PCT Filed: Feb. 9, 2015

(86) PCT No.: PCT/EP2015/052630

§ 371 (c)(1),
(2) Date: Aug. 10, 2016

(87) PCT Pub. No.: WO2015/121194

PCT Pub. Date: Aug. 20, 2015

(65) Prior Publication Data

US 2017/0011727 A1 Jan. 12, 2017

(30) Foreign Application Priority Data

Feb. 11, 2014 (EP) ..... 14154741

(51) Int. Cl.
*G10H 7/00* (2006.01)
*G10H 7/10* (2006.01)
(Continued)

(52) U.S. Cl.
CPC ..... *G10H 7/10* (2013.01); *G10H 1/04* (2013.01); *G10H 7/02* (2013.01); *G10H 7/08* (2013.01);
(Continued)

(58) Field of Classification Search
CPC .. G10H 7/10; G10H 7/02; G10H 1/04; G10H 2250/565; G10H 7/08; G10H 2250/205
(Continued)

(56) References Cited

U.S. PATENT DOCUMENTS 4,453,440 A * 6/1984 Mitarai ..... G10H 1/057 84/604
5,340,938 A * 8/1994 Sugita ..... G10H 1/04 84/605
(Continued)

OTHER PUBLICATIONS

Righetti, Marco; International Search Report and Written Opinion of the International Searching Authority; International Application No. PCT/EP2015/052630; May 11, 2015; European Patent Office; Rijswijk, Netherlands.
(Continued)

*Primary Examiner* — Jeffrey Donels
(74) *Attorney, Agent, or Firm* — Stevens & Showalter, LLP

(57) ABSTRACT

A method for the synthetic generation of a digital audio signal by means of periodic sampling of a waveform shall permit the user a particularly simple and intuitive access to the changing and creative transformation of the waveform on which the sampling is based. For this purpose, according to the invention, the waveform is specified by using control points, which, in addition to position parameters, may contain further attributes, of which the parameters and attributes can be changed individually over time by means of control signals or spontaneouseous intervention. The control-point values which result in this way can be interpreted either as direct amplitude-period phase or as magnitude-frequency or phase-frequency pairs. A continuous waveform is generated by interpolation or approximation of the control points and the parameters/attributes of the latter, which assume a time-specific value depending on the current control signals and other influences, and is used for further processing, e.g. spectral band limiting.

14 Claims, 6 Drawing Sheets

(51) Int. Cl.
*G10H 7/08* (2006.01)
*G10H 1/04* (2006.01)
*G10H 7/02* (2006.01)

(52) U.S. Cl.
CPC . *G10H 2250/205* (2013.01); *G10H 2250/565* (2013.01)

(58) Field of Classification Search
USPC ..... 84/604
See application file for complete search history.

(56) References Cited

U.S. PATENT DOCUMENTS 5,604,323 A * 2/1997 Hardie-Bick ..... G10H 7/02 84/604
6,124,542 A 9/2000 Wang
2011/0308376 A1* 12/2011 Ludwig ..... G10H 1/06 84/604
2017/0011727 A1* 1/2017 Bochmann ..... G10H 7/08

OTHER PUBLICATIONS

<Keimola, Jari; "Nonlinear Abstract Sound Synthesis Algorithms—Doctoral Dissertation"; Aalto University Publication Series; Jan. 1, 2013; Unigrafia Oy; Helsinki, Finland; pp. 1-65; http://lib.tkk.fi/Diss/2013/isbn9789526050164/isbn9789526050164.pdf.
Lyons, Rick; "How to Interpolate in the Time-Domain by Zero-Padding in the Frequency Domain"; 1999; Internet Citation; 3 pages; Retrieved from the intemet on Aug. 1, 2016; http://dspguru.com/dsp/howtos/how-to-interpolate-in-time-domain-by-zero-padding-in-frequency-domain.
Collins, Nick; "SplineSynth: An Interface to Low Level Digital Audio"; Proceedings of the 1999 Diderot Forum on Mathematics and Music: Dec. 2-4, 1999; Vienna, Austria; pp. 1-13; http://citeseerx.ist.psu.edu/viewdoc/download?doi=10.1.1.11.9924&rep=rep1&type=pdf.

* cited by examiner

METHOD FOR THE SYNTHETIC GENERATION OF A DIGITAL AUDIO SIGNAL

FIELD OF THE INVENTION

The invention related to a method for the synthetic generation of a digital audio signal by means of use of recurrently calculated amplitude values of a waveform.

BACKGROUND OF THE INVENTION

The synthetic generation of digital audio signals is used within the framework of sound synthesis for electronic generation of sounds. For this purpose, digital audio signals are used directly for sound synthesis immediately after their generation or, alternatively, stored in a storage unit for subsequent use. For the sound generation properly speaking, the digital audio signal is then used for activating a loudspeaker unit or the like, for example by means of a digital-analog transducer.

Sound synthesis is usually utilized for the purpose of generation of sounds which do not exist in nature. Another application is the imitation of natural sounds or natural instruments, such as piano, guitar or the like. Furthermore, sound synthesis also enables the specific or random coloration of natural sounds, for example by means of their superposition and processing with electronic effects, for a creative composition of music. Within the framework of synthetic generation of digital audio signals, one usually performs the periodic sampling of a suitably selected or predefined waveform or of an algorithmically generated signal, which gives as a result a value flow per channel ("resulting waveform") with a fixed output rate (so-called sample rate) and a fixed value resolution (so-called bit depth), one value per channel per output-rate clock step being provided.

With regard to these parameters, the following fundamental influences upon the character of the digital audio signal are found:

- The form of the resulting waveform determines the tone color.
- The frequency of the repetitions of the resulting waveform determines the tone pitch.
- If the resulting waveform changes from one repetition to the other, the tone color will change.
- If the frequency of the repetitions changes, the tone pitch will change.

To provide the waveform intended to be used as a basis for the sampling, usually a so-called oscillator is used, which can be modified as required, in accordance with the desired adaptation regarding tone pitch, tone color or other musical effects. Typically, oscillators generate waveforms with many partial tones, so that downstream processors as well as, typically, a low-pass filter, can attenuate or amplify these partial tones according to the wishes of the sound designer ("subtractive synthesis"). In the context of physical modeling, the oscillator assumes, e.g., the role of a vibrating string of a piano. The sound body corresponding thereto is then emulated, for example by means of a filter, whereas, in the context of additive synthesis, the oscillator is a sine wave of aspecific frequency, amplitude and phase. The additive synthesis generates complex waveforms through addition of many of such simple oscillators. Further ways of proceeding and a mixture thereof for sound generation are typically used in the context of a synthesizer.

The common methods of synthetic sound generation are based on the use of algorithms controlled by parameters fixed by the user. These algorithms generate the waveform on which the output is based, its changing over time as well as over the frequency and the latter's changing over time. The nature of the resulting waveform is usually not visible and not reconstructable to the user, or at best to a limited degree only, from the oscillator base form. The conventional methods can, therefore, be considered as "blackbox" methods. In this sense, the blackbox provides to the user only some parameters by means of which the user can define or modify the resulting tone, within the framework of the possibilities of the parameters provided. The user has no insight into, or influence upon, the internal procedures in the generating process of the tone. The user can just make the result visible by an oscilloscope or by sampling.

SUMMARY OF THE INVENTION

By contrast, the invention is based on the problem to provide a method for synthetic generation of a digital audio signal, offering the user a particularly simple and intuitive access to changing and creatively transforming the waveform on which the sampling is based.

This problem is solved according to the invention by using recurrently calculated amplitude or magnitude values of a waveform which is determined by a course which depends on period phase or frequency and is formed by control points which are formed by means of approximation or interpolation between a number of amplitude-period phase, magnitude-frequency or phase-frequency value pairs, wherein the parameter values and/or other attributes of the control points can be changed by means of respective associated control signals, and wherein the calculation of the amplitude or magnitude values is based on the approximation or interpolation of the control points determined by the currently existing control signals.

In other words, the waveform on which the generation of the audio signal is based is, thus, generated by means of control points which can be changed by the user, and its amplitude or magnitude values are recurrently calculated, the control points predefining, in the manner of supporting points, the approximate course of the wave function and the wave function properly speaking being generated through interpolation or approximation between these control points or supporting points. The amplitude, magnitude or else phase values of the wave function, used for generating the audio signal, are continuously updated in the manner of a cyclic or periodic sampling and newly calculated, in particular as required (i.e., for example, after a change of the parameters or attributes of one or several of the control points caused by the user or by control signals). This enables the user to influece the wave function and, thus, the audio signal generated on the basis thereof, in real time, i.e. the audio signal can immediately be changed by the user during its generation.

Preferably, the amplitude, magnitude or phase values of the control points, on the one hand, and the period-phase or frequency values of the control points, on the other hand, can be changed by respective individually associated control signals independently of each other and alternatively or additionally particularly preferably, also other attributes of the control points, by respective individually associated control signals independently of the amplitude or magnitude or phase values and/or of the period-phase or frequency values of the control points, so that the user has individualized possibilities of modification of individual parameters of the control points through correspondingly influencing the control signals. This enables a particularly great multitude of variation possibilities with regard to the sound properties of the generated audio signal.

As an additional simplification of influencing several control points together with their attributes, an attribute of a control point can, for example, mark the latter as an anchor point. When a control point marked as an anchor point is changed, all other control points lying between this anchor and a next anchor are also influened at the same time by the control signal applied to the anchor control point, so that the relations of the control-point parameters or attributes are maintained, relative to the initial state, between the anchor control points, after a change of the anchor control point.

The control points and their attributes are in particular provided for approximately predefining the course of the waveform, so that the rough course of the waveform can be defined having recourse to only a manageable number of parameters (namely the parameters defining the control points in the manner of coordinates). This makes it possible to define a continuous waveform by using a relatively small number of parameters or attributes, which can be rendered during a sampling cycle through evaluation based on the current value inventory of the control signals in any resolution. A time-domain waveform can in this case be processed for the purpose of band limiting either by oversampling or by Fourier Transform together with a band-limited re-transformation.

In case of Fourier Transform, it is also possible to influence the resulting magnitudes via a spectral filter, which in turn consists of a constructive waveform. The same applies to a constructively evaluated phase offset. In this case, the time-domain waveform is sampled by means of the desired tone pitch and transformed into the frequency spectrum. To guarantee a constant filter at different tone pitches, the filter waveform is evaluated with a high sampling rate and multiplicatively distributed to the resulting frequency bands of the magnitudes, for example by means of trapezoidal integration. The same applies to the phase offset, which is, however, distributed additively.

Alternatively, the constructive filter and the constructive phase offset can also be applied without previously transforming a constructively evaluated time-domain waveform in the sense of a direct additive synthesis. In this case, the filter, too, is distributed additively and not multiplicatively.

The use in real time is achieved by repeating this evaluating process at regular intervals (possibly in the sample rate), taking into consideration the current state of the control signals and the tone pitch to be output. A band limiting of the tone pitch to be output is effected automatically, if the spectrum, which, with increasing tone pitch, consists of fewer partial tones, is effectively increasingly "over-sampled" by increasing "zero padding" through the re-transformation. Tone-pitch changes between the updating cycles are of importance only in case of audio-rate modulation of the tone pitch and can in this case generate artefacts. To minimize the latter, the speed of the tone-pitch changes can be reduced, if necessary, for example by means of a low-pass filter.

The approximate predefination of the waveform by means of the control points can preferably be effected by determining the waveform by means of interpolation of the control points (i.e. determination of the waveform running through the control points, observing any predefined edge conditions) or by means of approximation of the control points (i.e. determination of the waveform running past the individual control points as closely as possible, observing a predefined optimation criterion). Preferably, polynomial-based interpolation, Bezier curves, b-splines, or NURBS are used for determining the course between control points, preferably adapting the basic conditions of the interpolation method in case of a change of the control points and/or the latter's attributes.

Particularly preferably, the waveform is composed, segment by segment, through linear combination of basic functions, two adjacent control points predefining in each case the edges and thus the edge conditions for each segment. Advantageously, the waveform is in this case composed of a number of wave segments which follow each other within a period phase—or, if processing is effected in the frequency domain, within a frequency band—, and are each defined by a segment-specific linear combination of a number of basic functions, the wave segments being connected at their segment edges, via one of the control points each, with the respective adjacent wave segment, and—in case of interpolation—for each wave segment, those linear coefficients being determined with which the respective wave segment has at its segment edges, in each case, within the framework of the local control point, predefinable, changeable amplitude or magnitude or phase edge values, and the values of respective updated linear coefficients being determined for the respective wave segment during the recurrent calculation and being taken as a basis for the calculation of the values.

The waveform is, therefore, composed, segment by segment, of a number of wave segments which follow each other temporally, the corresponding "partial waveform" being generated within each wave segment constructively or additively by means of linear superposition of a number of basic wave functions. Having recourse to sets of standardized basic wave functions, which are preferably stored in a library or the like, such as, for example, the particularly preferable cubic polynomials, Bernstein polynomials, b-spline basic functions or the like, each segment can, therefore, unambiguously be defined and determined, either by means of the linear coefficients used in the constructive superposition of the basic function or by means of the constructive superpositions of basic-function and control-point products in case of approximation. In this way, even relatively unconventional or complex waveforms can be described and defined having recourse to a limited number of parameters, and it is possible to generate and, thus, also to subsequently modulate or modify the waveform by editing these parameter sets. Especially by means of such a concept designed in the manner of a "constructive synthesis", it is in particular also possible to vary the waveform in real time, so that the user is offered new creative scopes.

The linear coefficients of the basic functions used for the constructive superposition are particularly preferably selected such that a desired (initial) partial wave is reproduced in a largely exact or at least approximated manner in the respective wave segment. The initial partial wave, which can be specified or predefined by a user or else be selected from waveforms stored in a library, is, thus, decomposed into a superposition of the basic functions.

In case of interpolation, the linear coefficients are preferably selected such that the amplitude of the waveform assumes predefinable amplitude edge values in the respective segment on the latter's segment edges. In this way, it is possible that a change of these amplitude edge values carried out by the user changes the partial waveform in the respective segment, as said partial waveform is defined by the basic conditions which can be predefined through the amplitude edge values.

A particularly preferred, more far-reaching possiblity to influence the changing of the waveform through the user can be achieved by selecting, in an advantageous development, the linear coefficients for each wave segment in such a way that each wave segment has on its segment edges a predefinable, changeable edge gradient. In this way, not only the amplitude values at the segment edges, but also their edge gradients, are predefined as edge conditions for the decomposition of the partial waveform of each segment into the basic functions. By modifying these parameters, the user can generate even relatively complex sound or music effects with a particularly simple handling. In case of a steady transition of the waveform between two adjacent segments, i.e. if the output-side amplitude value merges without jump into the input-side amplitude value of the adjacent segment, this can also be made available, in a simplified manner, for the purpose of editing through the user, by providing, as a changeable parameter, the angle between the two gradients meeting at the segment edge.

In case of approximation, the linear coefficients of the basic functions are advantageously predefined by means of a node vector, in which case the basic functions will not be changeable if the node vector is not changeable. The control points influence the course of the wave segment by being weighted with the basic functions in an overlapping manner. The approximation guarantees certain properties as well as the degree of continuity of the resulting waveform. By weighting of the control points and a non-linear distribution of the node vector, it is also possible to specify discontinuities. These parameters can be added to the control point as attributes and are, therefore, according to the constructive approach, changeable through control signals. Depending on the application, this procedure can offer advantages. For a point-by-point real-time evaluation, however, this approach is unsuitable because the course of the curve is not defined as a function of a period-phase or frequency value but as a function of a further independent parameterized value t. For a real-time evaluation of complete period phases or frequency bands, however, this approach can be used. In this case, the control signals, which change the control points and the latter's attributes, are always read out at the moment of the next evaluation of the complete waveform, which results in a time granulation of the control signals. By means of modern computers, this time granulation can, however, be kept very low and can additionally be blurred by means of interpolation of the resulting waveforms, so that a difference from direct point-by-point interpolation will be noticeable practically in extreme cases only.

From the point of view of the constructive synthesis, both approaches can be carried out in the same way and are just two different procedures by means of which the values between the control points can be determined.

As basic functions for the constructive generation of the waveform segments, preferably sets of functions, such as, for example, Bezier functions, B-splines, NURBS, or the like, can be provided. In all of these approaches, polynomial-based functions are used as basic functions; this is, therefore, preferably a polynomial decomposition of the waveform segments. In a very particularly preferred development, polynomials of the third degree or cubic polynomials are used as basic functions. These have the very particular advantage that with them, a relatively good approximation of desired functional courses within each segment can be represented, even with a particularly small number of linear coefficients. Furthermore, by means of an alignment to polynomials of the third degree or cubic polynomials, a functional behavior can be generated in a particularly simple manner, for which one has to have recourse only to the before-mentioned edge conditions of the respective segment (amplitude edge values, edge gradients in case of interpolation or a degree of continuity in case of approximation) without requiring another parameterization.

Advantageously, the waveform is composed of a number of wave segments which follow each other within a period phase or a frequency band and are each defined by a segment-specific linear combination of a number of basic functions and—in case of approximation—control points, the wave segments being connected at their segment edges near one of the control points in each case with the respective adjacent wave segment, and the linear combination of the current control points with the assigned basic functions—or in case of interpolation, the linear combination of the linear coefficients derived from the current control points—being taken as a basis during the recurrent calculation the values.

To enable a particularly user-friendly, preferably also real-time suitable, modification of the waveform and thus to offer particularly large scopes for musical creativity, a graphic user interface is particularly preferably provided for the modification of the waveform and, therefore, also for the generation of the digital audio signal. Namely, the "constructive synthesis", designed as explained above, in particular makes the waveform and the effects of its modification transparent for the user, by displaying, in a particularly preferred embodiment, the result, i.e. the waveform, on a suitable display device, such as, for example, a screen or display, because the user directly specifies the resulting waveform and its temporal changing, without taking the detour through algorithms. In this case, the limitations which are set by algorithms for the possible resulting waveforms are abolished. The result is one specimen from the universe of all imaginable waveforms mappable by the basic functions used.

Expediently, an associated input device is provided in this case, via which the control points and their attributes can be changed. In the manner of so-called "touching points", the user has thus direct access to the amplitude values in the segment-edge regions and the latter's gradients or possibly also to other attributes of the control points. Alternatively or additionally, the amplitude edge values and/or the edge gradients or the parameters and attributes of the control points are particularly preferably changed temporally, in accordance with a modulation function stored in a storage unit. In this way, the user is able to predefine the temporal development, with which the waveform and/or its segments change their state.

In another advantageous embodiment, the modulation function is generated, for its part, by use of recurrently calculated amplitude values of a waveform which is determined by means of a period-phase or frequency-dependent amplitude course formed by control points formed by means of approximation or interpolation between a number of amplitude-period phase or amplitude-frequency value pairs over a predefined interval, the parameter values and/or other attributes of the control points being changeable by means of respective associated control signals and the interpolation of the control points determined by the currently existing control signals being taken as a basis for the calculation of the amplitude values. In other words, preferably the concept of the constructive synthesis is also applied to the modulation function as such.

Advantageously, in case of interpolation, after a change of an edge value and/or an edge gradient, the linear coefficients for the wave segment limited thereby are newly calculated.

This is particularly advantageous when preferably using cubic polynomials or polynomials of the third degree as basic functions, because these can be defined unambiguously by means of the parameters "edge value" and "edge gradient", whereas, when using polynomials of a higher degree than the third degree, it is also possible to change coefficients without influencing the edge gradient and/or the amplitude edge value. In this case, further parameters for describing and defining the wave segment are available, for example the curvature of the curve at the segment edge.

In case of approximation, the basic conditions are advantageously selected such that the course of the curve necessarily gets a predefined cross-segmental degree of continuity and, therefore, a change of the control points entails a change of the curve, maintaining this degree of continuity. Further attributes can describe in this case e.g. a weighting of individual control points, with which the degree of continuity of the curve near the corresponding control points can be influenced, up to the extreme when the curve, similar to the case of interpolation, actually passes through the control points. After a control point or its attributes have been changed, at least the wave segments influenced of that control point are in all cases newly evaluated.

The number of segments to which the waveform is distributed is preferably selected as required. It is in particular possible to change the number of segments by inserting or eliminating segment limits or control points directly when processing or editing the waveform. Furthermore, it is in particular also possible to combine those sections of the waveform into a common segment, in which the user wants to make uniform or common changes or modifications. Advantageously, the number of segments is also a parameter that can be predefined and/or changed by the user.

As the final result is also output as a value flow, the latter can be further processed—if desired—in the conventional way, too, e.g. with convolution-based methods. Many of these conventional processes can, however, also be specified directly and explicitly in the constructive synthesis. Therefore, the possibility of a conventional further processing is to be understood as a concession to user habits and not as a technical necessity.

The "constructive synthesis" describes on its merits the waveform as a system which can generally assume any form. Contrary to algorithmic procedures, the waveform is defined unambiguously and explicitly through the superposition of basic functions by means of the linear coefficients and control points. It is a particular advantage that the result can be changed at will without the limitations of the algorithm. Effects, such as, e.g., a filter on an output wave, can be "designed" directly and changed in an unusual manner.

The described method of "constructive synthesis" creates as a result any imaginable waveform with the help of piecewise basic functions, preferably cubic polynomials, or other basic functions, i.e. similar mathematic constructs, which are linked with each other via changeable control or "touching points". These polynomials or basic functions are able, possibly by adding noise signals, to provide for most typical audio signals sufficiently precise approximations, which can efficiently be calculated.

A temporal changing of the design and, thus, of the resulting waveform, can be achieved by changing the control or touching points over time. In case of cubic polynomial interpolation, the possibilities of movement comprise in particular the shifting of the control points along the x-axis (=time/frequency) and the y-axis (=amplitude/magnitude/phase) and the changing of the angle of incidence and the angle of emergence of the curve running through the respective control point. In the musical context, it is advantageous to be able to specify the angle of incidence and the angle of emergence at the same ratio (by means of—figuratively—a rotation of the control point), in order not to introduce any undesired discontinuities at the control point. For desired discontinuities, a desired angle can additionally be specified at the respective control point. In case of cubic rational b-spline approximation, the possibilities of movement comprise, similar to those of cubic polynomial interpolation, the shifting of the control points and the changing of the weighting of the control points. In the musical context, the C2 continuity guaranteed with uniform weighting is a desirable property, in which case the continuity near a control point can be varied through weighting up to almost discontinuity.

That means that by designing waveforms by using piecewise polynomials (or other basic functions) and temporally changing their control points, the user is in a position to directly define the resulting waveform desired by him, without taking the detour through algorithms and parameters.

Based on the constructive synthesis according to the above-explained concept, the following further embodiments considered as particularly advantageous can be provided in any combination thereof:

Synthesis of Constructive Components

A complex waveform may sometimes require a complicated structure at control points and/or changes thereof. The splitting of the desired waveform into individual components, which are constructively generated and later added, enables a simplification of such a structure.

Constructive Modulators

A constructive waveform can be used for changing its own control points and/or attributes, or those of another constructive waveform.

Constructive processors

A constructive and changeable waveform can be used for mapping input values on output values, such as, e.g., in a saveshaper. Furthermore, a constructive waveform can also be used as a changeable kernel of a convolution, etc.

Constructive Sampling

A signal existing as a value flow can be transformed through (automatic) vectorization into a control-point based form, which results in an approximation of the signal. In constructive sampling, contrary to conventional sampling, the result is explicitly made available in the form of basic functions and their control points, which then in turn can be further changed and adapted.

Spectral Constructive Synthesis

The waveforms produced in the constructive synthesis can directly be output in the time domain as a signal. Alternatively, these waveforms can also be interpreted as signals in the frequency domain. By Fourier Transform or additive synthesis, this signal can be re-transformed into the time domain. In this case, it also offers itself to apply a constructive waveform in a scaling manner onto an existing magnitude spectrum. In this way, the functionality of a filter is given. This also applies similarly to the phase offset.

In the apparative implementation of the above-mentioned method, a user surface is particularly preferably used, which allows to work in different layers. These layers are advantageously a direct application of the above-described synthesis of constructive components.

The lowest layer represents in this case the constructive creation of wave elements. These preferably consist of a "constructively synthesized" waveform, as described above, which is preferably composed of piecewise polynomial functions. Such wave elements can be a component part of a waveform or act independently as waveshaper, guiding-signal shaper, spectral filter, spectral phase offset or convolution kernel.

The higher next layer represents components which encapsulate constructive wave elements together with particular parameters and possibilities of interaction.

The higher next layer represents waveforms which consist of several components mixed with each other. This components represent, as described above, preferably in the manner of standardized parts, wave elements in a form decomposed into a superposition of the basic functions, of which more complex waveforms can be composed in a particularly simple manner. These waveforms are used as an oscillator for generating the audio signal and as a modulator for generating control signals. The parameters of the components and the control points of the wave elements can be influenced by control signals and by external guiding signals.

The wave elements as well as all above-mentioned parameters can be specified separately per channel. Control points can be inserted, removed, shifted, rotated, angled or changed in other parameters or attributes.

The flexibility in creating the waveforms and the possibility to modulate all control points and parameters of the wave elements with the help of the same or other waveforms allows to provide results, such as, e.g., a saw-tooth waveform with a resonant low-pass filter sweep directly as the resulting waveform. The advantage consists in particular in that this designed result and the parameters used for its generation are explicitly available and, therefore, completely changeable. Thus, a more far-reaching processing and modification of the resulting waveform is possible in a manner which could not be realized before.

As the process of the constructive synthesis can generate any non-band-limited results, even if the initial waveform is band-limited, one uses advantageously, depending on the signal flow, internal oversampling of the oscillators or, optionally, of the entire system, and/or spectral band limiting by means of the Fourier Transform of the waveforms, based on the tone pitch to be output. In this way, the aliasing effects can be attenuated, depending on the oversampling rate, or, in case of Fourier Transform, depending on the further tone-pitch course, eliminated completely or almost completely. As to over-sampling, an oversampling rate of 8x has proved to be sufficient in practice for good results for most signals, an increase of the oversampling rate (and, with that, an improvement of the result in particular at very high frequencies) depending exclusively on the computing power.

A particularly interesting and preferred development of the concept of "constructive synthesis" consists in the so-called "constructive sampling". Starting out from the method of generating changing waveforms by means of changeable control-point-based interpolation/approximation, it can be provided to go back from the result. In this case, an automatic image of an already existing, temporally changing waveform could be derived as an approximation by means of algorithms.

The control points determined are then preferably shown on a display unit or a display and can regularly be further processed from there. That means that in a first phase, the automatically created control points can be revised or the underlying (automatic) vectorization algorithm can be re-parameterized, in order to reproduce the measured result as precisely as possible. Furthermore, it is possible—and that is the actual advantage over conventional sampling—to specifically change the result in subsequent phases in order to generate new tone colors, starting out from the tone experience heard. Therefore, the mixture of sampling and constructive synthesis offers a novel sound-design tool.

A further preferred development is the spectral constructive synthesis. This embodiment takes into consideration that there are different possibilities to interprete the waveforms. The time domain maps the waveform analogously to the movement of the loudspeaker diaphragm. That means, it shows the (negative or positive) deflection of the diaphragm in relation to time—this representation describes the appearance of the waveform. With this, one can make precise statements on transients, but only general statements on the contained frequencies (partial tones).

Alternatively, one can also consider signals in the frequency domain, which splits the signal into partial tones and the latter's amplitudes. In the frequency domain, one can make precise statements on the contained partial tones. Per DFT (Discrete Fourier Transform) or additive synthesis, one can transform a signal from the frequency domain into the time domain, which signal, in turn, can then directly control the loudspeaker diaphragm.

In case of constructive synthesis, one can use a constructively synthesized waveform to map partial tones of a DFT. Depending on the tone pitch to be output, the DFT requires a number x of magnitude and phase values, each magnitude value representing a frequency with a multiple of the tone pitch to be output and each phase value representing a phase shift (relative to 0 degrees of a cosine). As the constructive waveform exists in continuous form, it can be sampled at any intervals, so that, therefore, each tone pitch which is mappable by an even number of samples can be mapped. For tone pitches which do not contain an even number of samples, preferably oversampling, interpolation or window methods are applied. Alternatively, the higher next number of powers of two of samples can be calculated relative to the desired tone pitch, and thus, an optimized Fast Fourier Transform (FFT) algorithm can be used. In practice, it generally turns out that the detour through the FFT is worthwhile. The transformation into the time domain is then carried out with an FFT (or DFT) which is increasingly highly resolved by "zero padding", depending on the tone pitch to be output. This has the effect that the resulting waveforms for increasing tone pitches exist in increasingly strongly oversampled form, so that they can be read out without aliasing effects.

This way of proceeding, i.e. the constructive synthesis in the frequency domain, gives the user a constructive system, with which the distribution of partial tones and their temporal changes within one signal can precisely be specified. This can be advantageous over the time-domain representation, in a situation-related manner, because the user works with a tool which composes the waveform from musically understandable partial tones. It is also possible, in a particularly advantageous embodiment, to first of all transform a constructive time-domain waveform by means of the above-described FFT into the frequency domain, and to afterwards modify the resulting magnitudes and phases by means of other constructive waveforms, prior to the above-described re-transformation. This reflects the common procedure of, for example, a subtractive synthesizer, in which the oscillator (time-domain waveform) is modified through a filter (frequency-domain waveforms).

A very particularly preferred embodiment of the before-mentioned concept, which is considered as independently inventive, is the generation of the waveform or of the waveform segments by means of additive or constructive superposition of individual components, which, for their part, can preferably be generated according to the before-mentioned concept of generation through linear combination of suitable basic functions. The latter can in another advantageous embodiment additionally be equipped with parameters permitting to put individual components in relation with other components. In such a component-based synthesis, the before-mentioned components are preferably made available in the manner of standardized parts or modular units, of which the waveforms can be composed. The components are, therefore, for their part, modular units or wave elements for the synthesis of the waveform and are, for their part, composed of the basic functions in the manner of a superposition. The waveforms composed of the components are then preferably used as an oscillator for generating the audio signal and as a modulator for generating control signals. The above-mentioned components are expediently selected such that with them, results can be formed in a simple manner, which typically occur in synthetically generated digital audio signals.

In the following, the particularly preferred components are described, which are preferably used in an apparative implementation of the concept according to the invention. Depending on the application, however, other components, possibly in a supplementary way, can also be advantageous. Preferably, the below-mentioned components are used, each signal-generating component (with the exception of the noise component) having an independent frequency, phase and amplitude. The frequency is in this case always relative to a base frequency, which is predefined by the user by means of a guiding signal. As wave elements of the components, the following components are particularly preferably provided for easier access (preferably in the manner of a library):

1. An Oscillator Component

The oscillator component is intended as a changing constructive wave element which can be considered as a fundamental oscillator. In addition to the parameters of the control points and their attributes, there is a frequency offset which can be changed by control signals, a phase offset, and amplitude parameters. The frequency offset is to be seen in this case relative to the base frequency to be output. Typically, there are several of these components for the generation of a complex tone.

2. A Shift Component

This component preferably consists, for its part, of a constructive waveform which, however, defines a frequency change, dependent on the phase of the base frequency, of one or several other oscillator or step components (target wave elements). A frequency multiplier, that multiplies the frequency of the target waveform as a function of the base frequency, allows to make the target wave element, which repeats itself, change longitudinally over time. As a result, this process is similar to a frequency modulation. A sweep of the frequency multiplier allows to realize phase synchronization effects. As these frequency changes are applied in the constructive waveform generation, all of these effects are band-limited, as far as the approach of the Fourier Transform, as described above, is pursued.

3. An Envelope Component

Similar to the shift components, this component consists, in turn, of a constructive waveform, which scales the amplitude of the target-wave components as a function of the phase of the base frequency. Therefore, it is possible to create, for example, an envelope allowing a frequency modulation of the target-wave element, which is phase-synchronized to the base frequency, without discontinuities arising at the edges of the base frequency.

4. A Step Component

Contrary to the oscillator component, this basic wave element is not based on a constructive waveform—it is specified by means of a step editor allowing the efficient representation of forms with sharp edges. In addition to frequency-offset, phase-offset and amplitude parameters, it possesses a variable 1-pole low-pass filter, with which the degree of the sharpness to be conveyed to the signal by means of the sharp edges can be adjusted 5. A Noise Component This component generates white or pink noise and, therefore, offers the possibility to add a signal without tone pitch (without a pattern that repeats itself). Preferably, it additionally possesses a Sample&Hold functionality, which makes it possible to sample new noise values at certain time intervals only. That is of particular interest in view of the modulator context. Finally, this component also possesses a 2-pole low-pass filter, with which e.g. the Sample&Hold transitions can be made softer.

6. A Spectral-Filter Component

This component, in turn, consists of a constructive waveform, which is, however, applied in the frequency domain. Except the control-point parameters and their attributes, it does not possess any further parameters. Similar to the shift component and the envelope component, it can be applied onto the oscillator components and the step components. The target-wave components are transformed for application into the frequency domain, based on the current desired tone pitch, and the filter-component waveform, which is preferably available in high resolution and independent on the tone pitch, is distributed onto the resulting magnitude spectrum multiplicatively by integration, preferably by trapezoidal integration.

7. A Spectral Phase-Shift Component

This component behaves analogously to the spectral filter component, with the difference that the latter's waveform is distributed onto the phase spectrum of the target waveform(s) additively.

8. A Master Component

This component preferably contains a parameter for amplitude scaling and/or a parameter for specifying the so-called clipping behavior of the final mixed signal.

The result of component accumulation is the waveform. Alternatively, one can also multiply the value flow of individual components, in order to generate a ring modulation. Within the components of the waveform, the output signal of the individual components can, in turn, be used for modulating the control points and parameters in the other components. In case of the oscillator, this modulation is preferably effected in audio rates and enables common methods, such as FM, AM, even between the components, etc. Furthermore, the phases of the components can be synchroniziert to each other, thus enabling, e.g., phase sync.

Such a component-based synthesis concept enables, in addition, a novel, particularly advantageous concept for visualizing audio signals, which is also considered as independently inventive and is explained in more detail in the following.

Common visualization methods are based upon the resulting waveform heard, i.e. upon the audio signal as a whole, in which case no differentiation can be made between individual parts of the signal flow. As a rule, common visualization methods permit only to recognize frequencies, for example with the help of the Fourier Transform, as well as to recognize transients, whereas a representation derived from the individual parts of the signal flow permits to "construct" a visualization taking into account the underlying signal flow of the generated tone. By selecting the corresponding value flows within the signal flow, the observer's attention can be drawn, via the eye, to particular internal processes of the tone. In this way, e.g. a constant audio flow can be diversified for the listener/observer by means of the visual stimulation alone, which emphasizes various processes in the composition of the audio flow. This results in a more precise understanding of the tone, which is an advantage both in the context of sound design as well as in the context of sound experience.

Such a "constructive visualizer" is not to be understood as an external instrument placed on top of an audio flow, but as a tool integrated into the audio flow, enabling "guided hearing". The untrained ear will hear a tone with less differentiation than a trained ear, furthermore, the ear can only focus on certain areas in a tone. Through the visual stimulation, it is now possible to draw the attention of all observers/listeners to details in the tone and "guide" their focusing onto a particular element.

For such a visualization, the following is particularly preferably provided:

1. The possibility to access individual parts within a signal flow.
2. A method producing from the tapped signal flows a coherent result perceptible in a visual or other sensomotorical manner.

Common audio visualization methods do not allow to access individual value flows within the signal flow. As a rule, only the final signal is supplied as a value flow. This signal is then used for being analyzed and for visualizing the findings of the analysis in a suitable manner. As this analysis considers the signal as a whole, it is not possible to extract an individual element which had been used for constructing the audio flow.

The "constructive visualizer" implements the two abovementiond aspects. First of all, individual parts within the signal flow are tapped, preferably having recourse to the interpolation or approximation methods used in the synthesis of the audio signal. In the preferably provided second step, an integrated visualization method forms a complex, changing and colored geometry by means of the tapped signal flows.

In the above-described component-based constructive synthesis, it is possible to tap individual parts of the signal flow at any components or to reconstruct them by means of the control points associated therewith. These components contain additional information, such as the frequency and the phase of the outgoing value flows. They constitute the basis for the realization of the expressive visualization described in the following.

In general, individual parts of the signal flow, as far as they are made available by means of an interface, can be tapped in every system. The component-based constructive synthesis, however, offers the particular advantage that the parameters necessary for the generation of the individual components for the respective wave segments, namely the control points and their attributes and possibly the further parameters of the components, are available and/or archived, so that the result of the synthesis and the temporal course of said result are fully defined on the basis of the currently existing control-signal state. In this way, it is possible to visualize, in addition to the result heard, also a projection of the result still to be heard, which adapts itself at any time by means of the current modulation state. In conventional, for example convolution-based, methods, this is not possible, because a future step depends on the previous input and can, therefore, not be predicted.

A particularly preferred possibility to visualize the value flows of selected parts within the signal flow, is presented in the following. It is in particular the aim of this preferred visualization to realize a uniform and temporally changing and coloring geometry from the tapped and/or projected signals of the components. To carry out the visualization, one advantageously proceeds as follows:

A three-dimensional space and a definable set of vertexes serve as starting point. Each vertex has an X, a Y and a Z-coordinate (dimensions) and is associated with a red, a green and a blue value (color channels).

For each dimension and for each color channel, it is possible to tap or determine, from the available parameters, signals from the signal flow, which determine the values of the selected dimension or of the color channel. Optionally, a linear course or a constant value can also be predefined for this purpose instead of a tapped or projected signal. Thereby, the mesh generated by means of the vertexes has the theoretical possibility to assume any kind of three-dimensional form and color. The individual dimensions/color channels can be scaled independently of each other, and the complete mesh can be rotated about any axis and be shifted in the three-dimensional space. This scaling, rotation and shifting can also be temporally changed via control signals or guiding signals.

It is a preferred aim to visualize the changing of the tapped and/or projected value flows over time, independently of their basic frequencies, so that it is possible to work with a whole period in one step and, thus, a determination is possible independently of the frequency. For this purpose, preferably the information of the frequency of the signal in the components is provided. Alternatively, particularly for the case that the frequency information is not explicitly available, it can also be determined analytically.

In order to also offer the possibility to visualize at the same time past and/or future value flows, in addition to the instantaneous state, a two-dimensional buffer is advantageously used for each dimension and for each color channel—one dimension for the period of the value flow and the second dimension for the time.

The tapped signal can be mapped onto a dimension/color-channel buffer in the following manners:

1. Waterfall running
   Here, the tapped signal is written into the first row of the buffer. All other rows are shifted backwards and the last row is canceled. This can efficiently be realized in the form of a circular buffer.
2. Waterfall stationary
   Here, the tapped signal is written into the n-th row of the buffer, n being incremented each time. If n exceeds the number of rows, it is reset to zero.
3. 2D interpolation
   Here, a separate signal is tapped for each dimension of the buffer and the values are generated by means of bilinear interpolation.

To realize the mapping of tapped signals onto the individual dimensions/color channels, preferably vertex and fragment shaders are used, which are provided by the OpenGL standard. The vertex and the fragment shaders can access two-dimensional data sources (textures). This possibility is used to create the geometry. For each dimension and for each color channel, a dedicated texture is created. Each texture has the same size (#x-values*#y-values) and this size also determines the number of available vertexes. The textures are mapped onto the vertexes in such a manner that each texel (a point in the texture) identifies a vertex. The vertex shader can now read out, from the texture of the corresponding dimension, a position for each vertex by means of the corresponding texel. The same applies to the fragment shader, the latter filling the surfaces between the vertexes with color values which are derived from the surrounding vertexes by means of interpolation of the color values of the texels.

Therefore, it is possible to generate any imaginable three-dimensional form and color by means of two-dimensional textures.

In general, the following can be said about the dimensions:

If all dimensions are constant, a point will result.

If two dimensions are constant, a straight line may result.

If one dimension is constant and one is linear, x-y graphs can be generated.

If one dimension is constant, any straight lines/curves/circles can be drawn.

If two dimensions are linear, height fields/topographies can be generated.

If one dimension is linear, e.g. hose-like shapes can be generated.

If no dimension is constant or linear, e.g. curved hose-like shapes (conuts) can be generated.

The same also applies in principle to the color channels.

Therefore, the above-mentioned visualization on the basis of the component-based constructive synthesis makes it possible to represent particular characteristics of the tone heard in a temporally exactly synchronized and visually emphasized manner. As visual stimulations may draw the attention to certain details in a tone, this visualization allows a more intensive and more precise listening. Furthermore, the possibilities of expression are unlimited, because every imaginable geometry can be generated. This is an attractive benefit for both the producer and the listener, which subsequent methods not integrated into the signal flow cannot offer. Of course, the geometry created in this way can be further modified in a further post-processing step by means of, for example, convolution or feedback-based image processing algorithms.

The advantages achieved with the invention consist in particular in that the constructive synthesis through recourse to the segment-wise decomposition of the waveform into a linear combination of basic functions creates a particular transparency and also manageability regarding the nature of the waveform. In this way, among others, changes and influences of the waveform are created, also taking into account its future course or behavior, which are not possible with the present methods. By contrast to the concepts known so far, to be considered as "blackbox" methods, the constructive synthesis provided now can be considered as a "whitebox" method, in which the user has full transparency regarding the resulting waveform and explicitly specifies the latter's shape and temporal change. In the preferred apparative implementation, the user acts, furthermore, as a "greybox" creator, by defining parameters inside the whitebox, which are available outside the whitebox. Thus, the behavior of the whitebox defined by the user can be controlled through parameters, as in conventional synthesis methods. However, the user has the possibility of insight into the whitebox and can reconstruct the internal procedures in the process of origination of the tone and the latter's parameters.

The advantage of this way of proceeding is an unlimited freedom of design regarding the definition of the waveform and its temporal changing. Results can be created which are not provided or even possible with the parameters of the blackbox method.

BRIEF DESCRIPTION OF THE DRAWINGS

An exemplary embodiment of the invention is explained in detail by means of a drawing, in which.

Identical parts are identified in all figures by the same reference numbers.

DETAILED DESCRIPTION OF THE INVENTION

Figure 1:
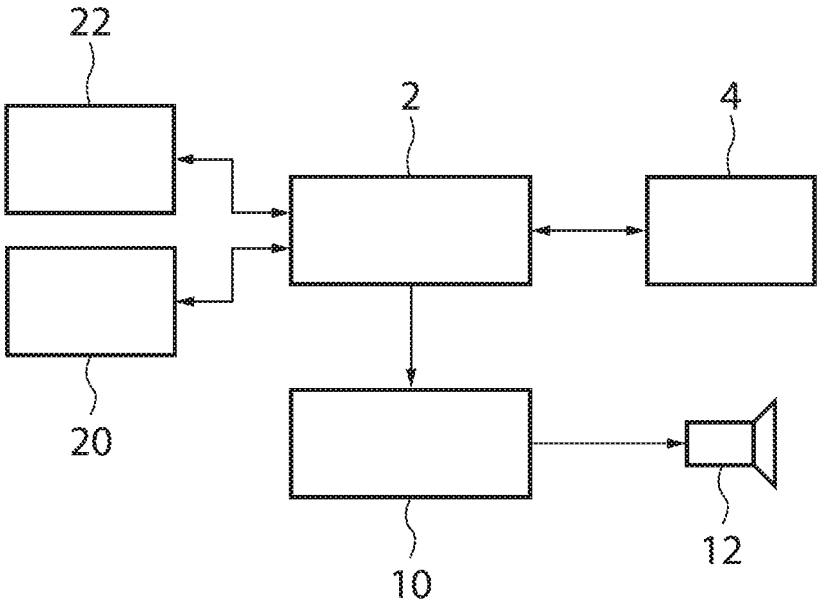
FIG. 1 shows a synthesizer for the synthetic generation of a digital audio signal FIGS. 2-9 each show a sequence of a waveform displayed on a display unit of the synthesizer of FIG. 1 and edited there.

The synthesizer 1 according to FIG. 1 comprises a central unit 2, in particular a computer, in which a so-called oscillator or a waveform can be processed, which can be modified as required, depending on the desired adaptation regarding tone pitch, tone color or other musical effects. The oscillator or the waveform is generated from the construction of piecewise basic functions and control points in the context of the system (components, temporal changes, etc), which is stored as a data set in the storage 4. As the control points can be evaluated continuously, the resulting construct can also be evaluated continuously. Therefore, a sampling of the underlying construct is possible in any frequency, so that any tone pitches can be generated. Sampling takes place at a constant sample rate, and the sampled values are stored with a constant bit depth in a storage 4 and/or directly output as a digital audio signal, possibly after a spectral band limiting and further processing, which digital audio signal is transformed into an analog audio signal in a downstream digital-analog transducer 10. The analog audio signal is then used for selecting a downstream loudspeaker unit 12 and supplied to the latter.

The synthesizer 1 is specifically designed for offering the user a particularly simple and intuitive access for changing and creatively transforming the waveform on which the sampling is based. For this purpose, a processing unit 20, i.e. in particular an editor, is associated with the central unit 2, via which processing unit 20 a modification or processing of the oscillator read into the central unit or of the waveform available in the central unit 2 is possible. Furthermore, a display unit 22, i.e. in particular a screen or a display, is connected to the central unit 2, via which display unit 22, the processing of the waveform in question is directly displayed and made reconstructable to the user. In the exemplary embodiment, the processing unit 20 is designed as a separate unit, separated from the display unit. Alternatively, however, in a particularly preferred embodiment, it can also be integrated in the display unit 22, in particular when designed as a touch screen.

In order to particularly simplify the processing of the waveform and to enable also novel effects, for example through extrapolation of values or the like, the waveform is provided for being processed in the central unit 2 in a particularly processing-friendly manner. For this purpose, the waveform is subdivided into a number of wave segments following each other temporally, so that the waveform as a whole can be obtained by composing the wave segments following each other temporally (or, in case of processing in the frequency domain, following each other in frequency). Each wave segment is in this case reproduced, in the manner of a mathematical decomposition, by means of a segment-specific linear combination from a number of basic functions and control points, the particularly preferred cubic polynomials, or, in other words, polynomial functions of the third order, being used as basic functions in the exemplary embodiment. The linear coefficients for each wave segment are chosen in the interpolation-based exemplary embodiment in such a way that each wave segment has at each of its segment edges predefinable, changeable amplitude edge values and gradients.

In this way, a user-prompted changing or processing of the waveform through a corresponding modification of the respective linear coefficients is possible, so that even highly complex changes can be made with a relatively limited number of parameters.

The number of segments in this decomposition of the waveform can be predefined and also modified by the user. It can in particular be taken into consideration whether, and if so, to which degree sections are present or shall be present in the waveform, which shall be characterized by a particular characteristic or a particular behavior; it can be expedient for the user to associate with each of such individualized sections in the waveform a wave segment of its own, so that a specific and selective modification of the respective section is possible.

Examples of waveforms which can be modified in this way are shown in FIGS. 2 to 9 in the form of sequences of screenshots of the display unit 22. The waveform represented there in each case as an amplitude line 30 comprises the wave segments 32, which at their segment edges 34, in so-called touching points 36, merge into the respective adjacent wave segment 32. The linear coefficients for each wave segment 32 are in the particularly preferred exemplary embodiment chosen such that each wave segment 32 has at each of its segment edges 34 a predefinable, changeable edge gradient. The amplitude edge values and the edge gradients can in this case directly be changed via the processing unit 20, i.e. in particular via the touch screen, by selecting the touching points 36 and inputting the corresponding values via a context-related menue or a context-related editor.

The amplitude edge values and the edge gradients can also be changed temporally in accordance with a modulation function stored in the storage 4, in addition to the direct changing through the user. In this case, for example, a periodic change of the respective parameters in the manner of an oscillation or else a linear change in the sense of a continuous enlargement of the respective parameters or any other changes might be provided.

In the exemplary embodiment, it is provided, in a very particularly preferred embodiment, that each modulation function, for its part, is composed of a number of wave segments which follow each other temporally and are each defined by a segment-specific linear combination of a number of basic functions and control points, the linear coefficients for each wave segment being chosen in the exemplary embodiment such that each wave segment has at each of its segment edges predefinable, changeable amplitude edge values and/or edge gradients. After a change of an amplitude edge value and/or an edge gradient, the linear coefficients for the wave segment limited thereby can be newly calculated.

By means of the sequences shown in FIGS. 2 to 9, some possible modifications are represented by way of example. These can be used individually or in any combination with each other for a desired and creative modification of the waveform.

Figure 2:
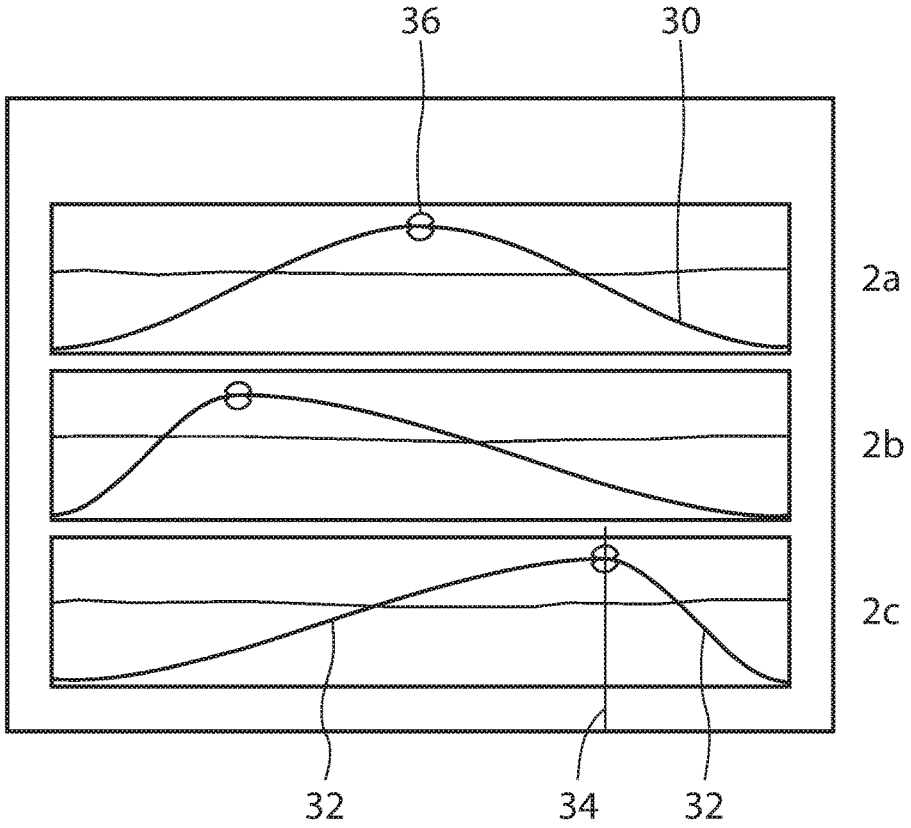

The sequence according to FIG. 2 is an example of a change of the waveform by means of a horizontal shift of a control or touching point 36. In the initial state according to FIG. 2*a*, the waveform available in the form of the amplitude line 30 is designed in the manner of a symmetrical embodiment regarding the x-axis or period-phase axis and comprises two wave segments 32, which are connected with each other at their common segment edge 34 via the control or touching point 36 and merge into each other. In each of the wave segments 32 following each other temporally, of which the waveform is composed, the amplitude line 30 in each wave segment 32 is calculated in the central unit 2 by means of a segment-specific cubic polynomial, i.e. a segment-specific linear combination of a number of polynomials used as basic functions, and shown on the display unit. In this way, in each wave segment 32, the part of the waveform corresponding thereto is mathematically defined and characterized by means of a relatively low number of four coefficients (i.e. the linear coefficients for the polynomials up to the third order). With these, the respective wave segment 32 can be described for its current state, but can, if required, also be extrapolated into the future. Thus, the corresponding "partial waveform" is generated constructively or additively, within each wave segment 32 by means of linear superposition of a number of polynomials provided as basic wave functions.

The linear coefficients for each wave segment 32 are chosen such that the amplitude line 30 in each wave segment 32 has at each of its segment edges 34 predefinable, changeable amplitude edge values. At the transition point defined by the control or touching point 36 shown in FIG. 2*c* between the adjacent wave segments 32, said wave segments 32 are suitably chosen for a steady transition between the adjacent wave segments 32 in the example shown.

To modify the waveform, for example to implement artistic or creative effects, the control or touching point 36 can be shifted or an automatic shifting by means of control signals can be specified via a context menue, with the help of the processing unit 20. Accordingly, the linear coefficients of the cubic polynomials in the wave segments 32 are newly calculated and determined, in order to correctly reproduce the modified design. The waveform modified in this way is then made available by means of its mathematic definition via the constructive synthesis for the sampling provided for generating the tone.

The sequence according to FIG. 2 shows a modification of the wave function by shifting the control or touching point 36 in the x-direction, corresponding to the time axis of the wave function. As compared with FIG. 2*a*, FIG. 2*b* shows the wave function after the shifting of the control or touching point 36 to the left, FIG. 2*c*, however, to the right. Such a shifting in the x-direction also means that the limit between the wave segments 32 is shifted accordingly, i.e. that, from the temporal point of view, in each case one of the wave segments 32 has after the shift a correspondingly larger part in the temporal interval of the wave function as a whole.

Figure 3:
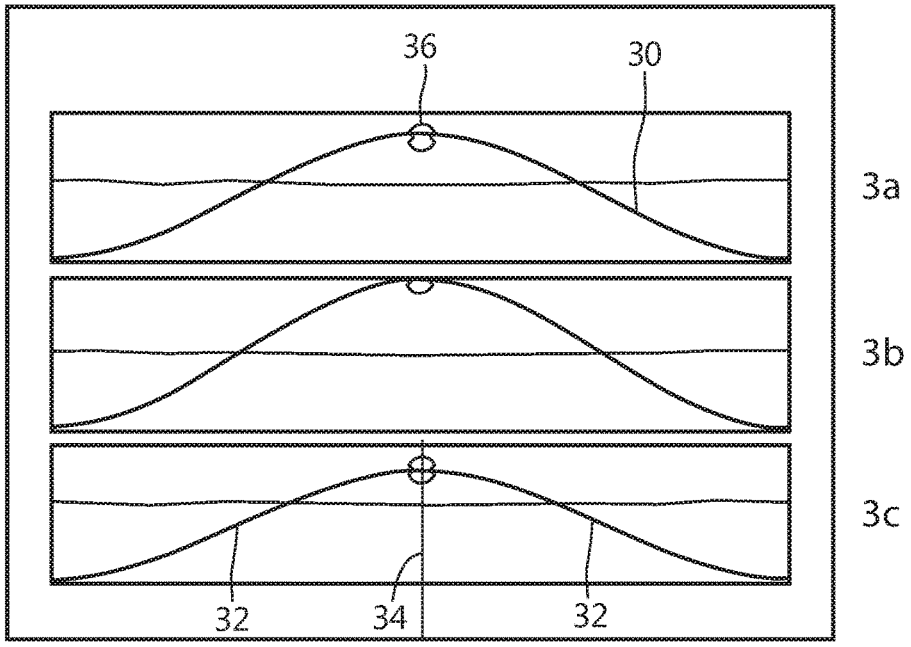

Accordingly, the sequence according to FIG. 3 shows a modification of the wave function by shifting the control or touching point 36 in the y-direction, corresponding to the amplitude of the wave function. As compared with FIG. 3*a*, FIG. 3*b* shows the wave function after the shifting of the control or touching point 36 upwards, FIG. 3*c*, however, downwards. Such a shifting in the y-direction substantially means a corresponding change of the amplitude of the wave function as a whole.

Figure 4:
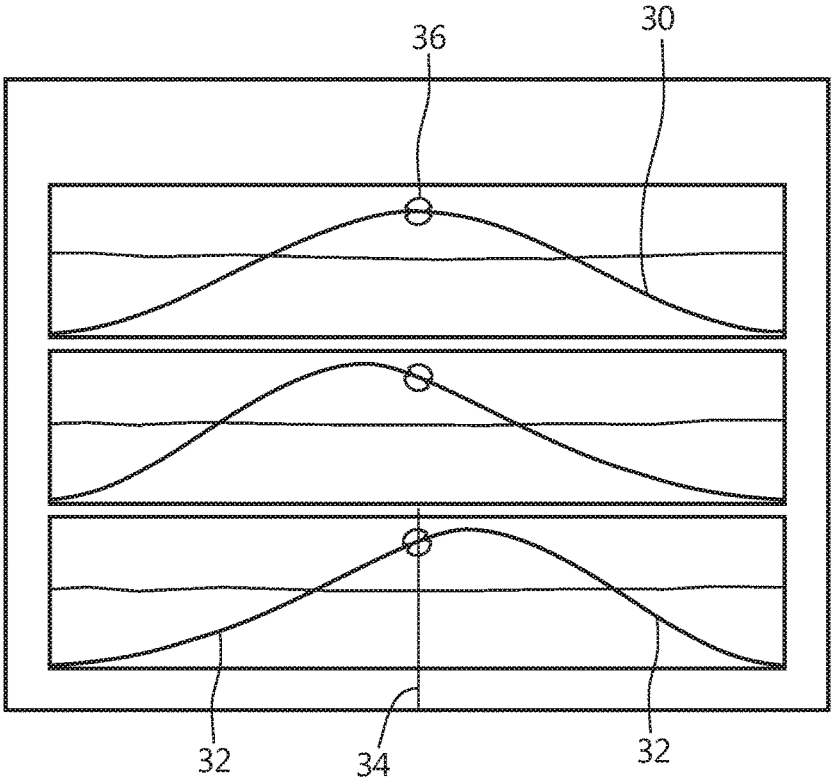
Figure 5:
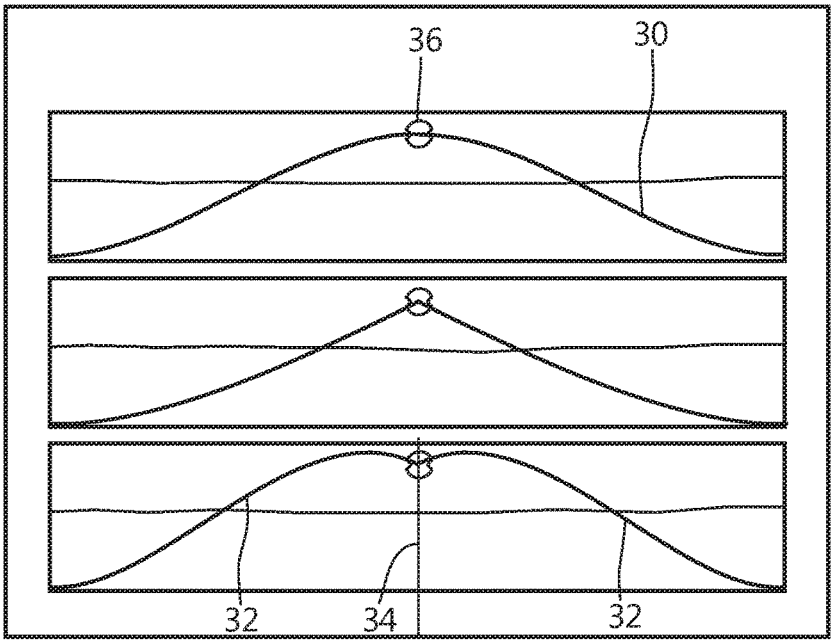

The linear coefficients of the cubic polynomials in the wave segments 32 are, on the one hand, chosen such that each wave segment 32 has at its segment edges 34 the respective amplitude edge values which are predefinable and possibly changeable by means of the control or touching points 36. Furthermore, the linear coefficients of the cubic polynomials for each wave segment 32 are, however, also chosen such that each wave segment 32 has at each of its segment edges 34 a predefinable edge gradient. The latter can individually be changed by the user, which is made possible in the exemplary embodiment through a suitable configuration of the editor by means of a rotation of the respective control or touching point 36, as a whole or else independently for each segment edge 34. The sequence according to FIG. 4 is an example of such a rotation of the control or touching point 36, in which on both sides of the segment edge 34 between the wave segments 32, the edge gradients are changed corresponding to each other. By contrast, the sequence according to FIG. 5 is an example of a change of the edge gradients on both sides of the segment edge 34 between the wave segments 32 separately from each other. Such a separate change of the edge gradients results in a change of the angulation in the control or touching point 36.

Figure 6:
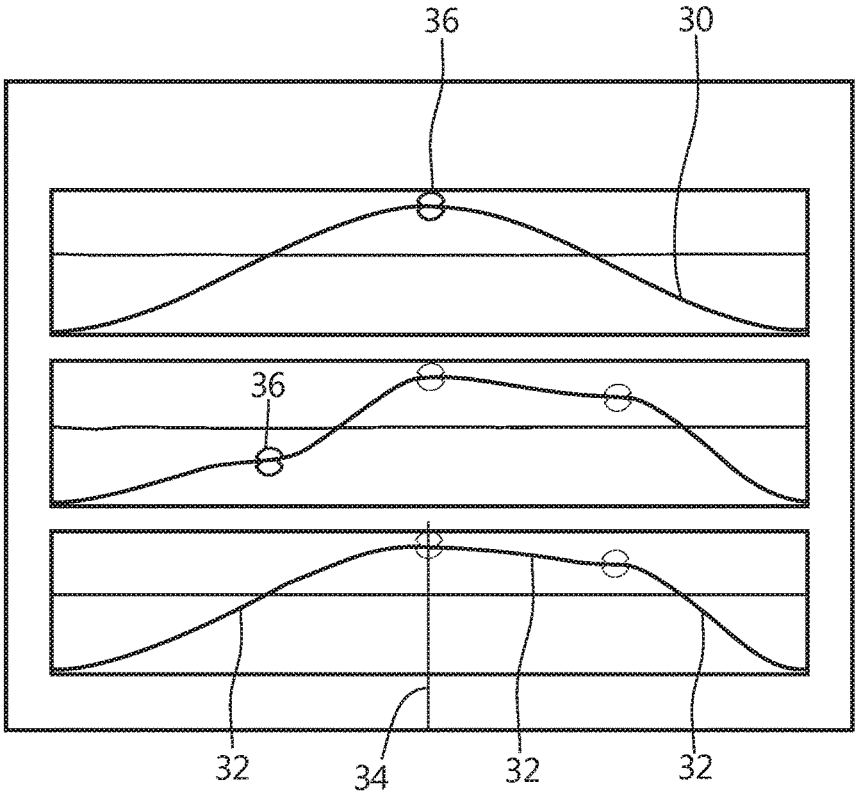
Figure 7:
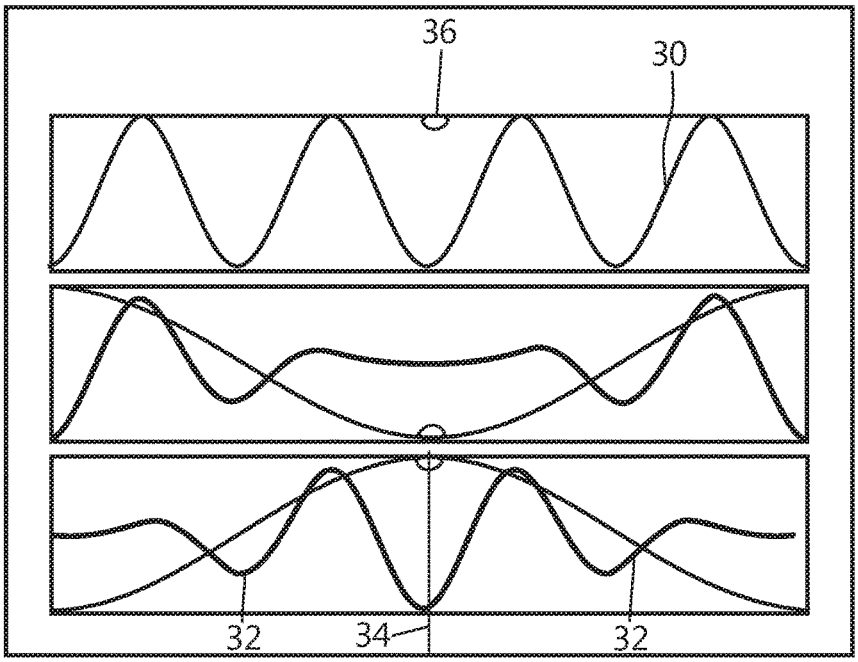
Figure 8:
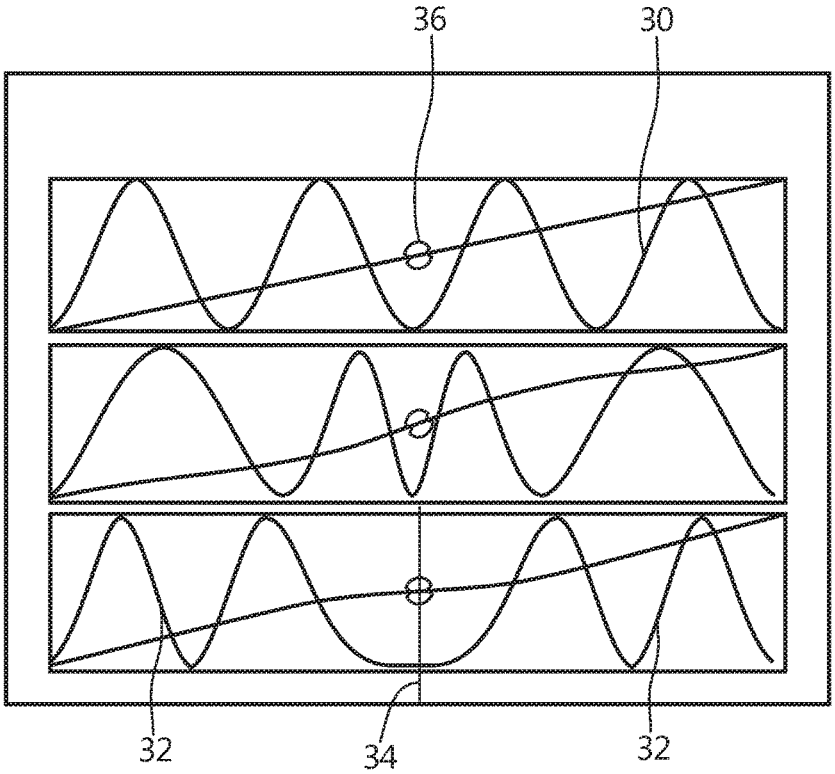
Figure 9:
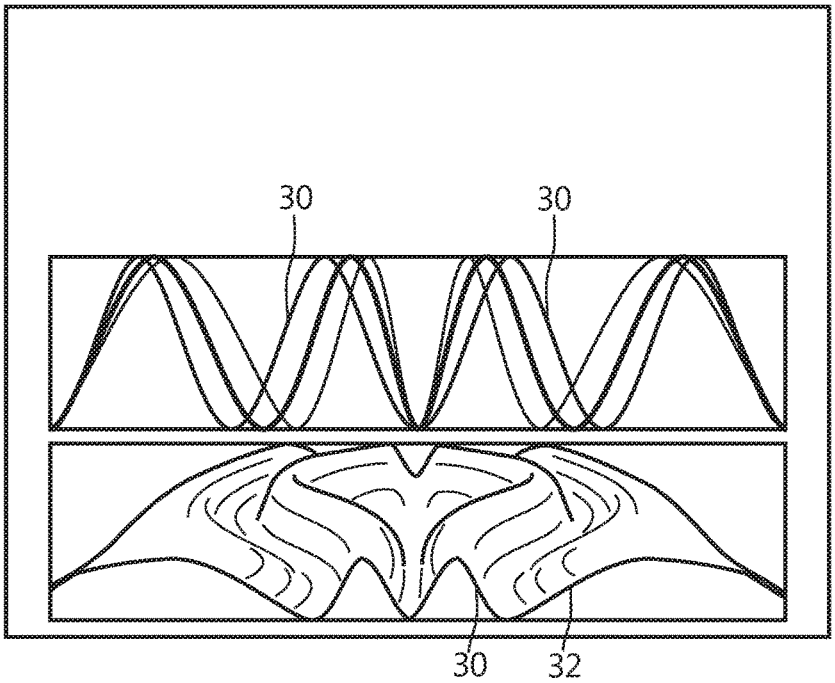

The number of control or touching points 36 and, thus, the number of wave segments 32 from which the wave function is composed, can also be changed by the user. FIG. 6 shows an example of adding or removing control or touching points 36 and, consequently, modifying at the same time the number of the wave segments 32.

By suitable superposition, modulations of a wave function as such can analogously be edited and changed. Examples thereof are shown in the sequences according to FIG. 7 (amplitude modulation of a constructive waveform by shifting a control or touching point 36 of another constructive waveform, FIG. 8 (frequency modulation of a constructive waveform by rotating a control or touching point 36 of another constructive waveform), and FIG. 9 (frequency modulation with a change (over time) of rotation on the basis of a sinusoidal constructive waveform).

Figure 10:
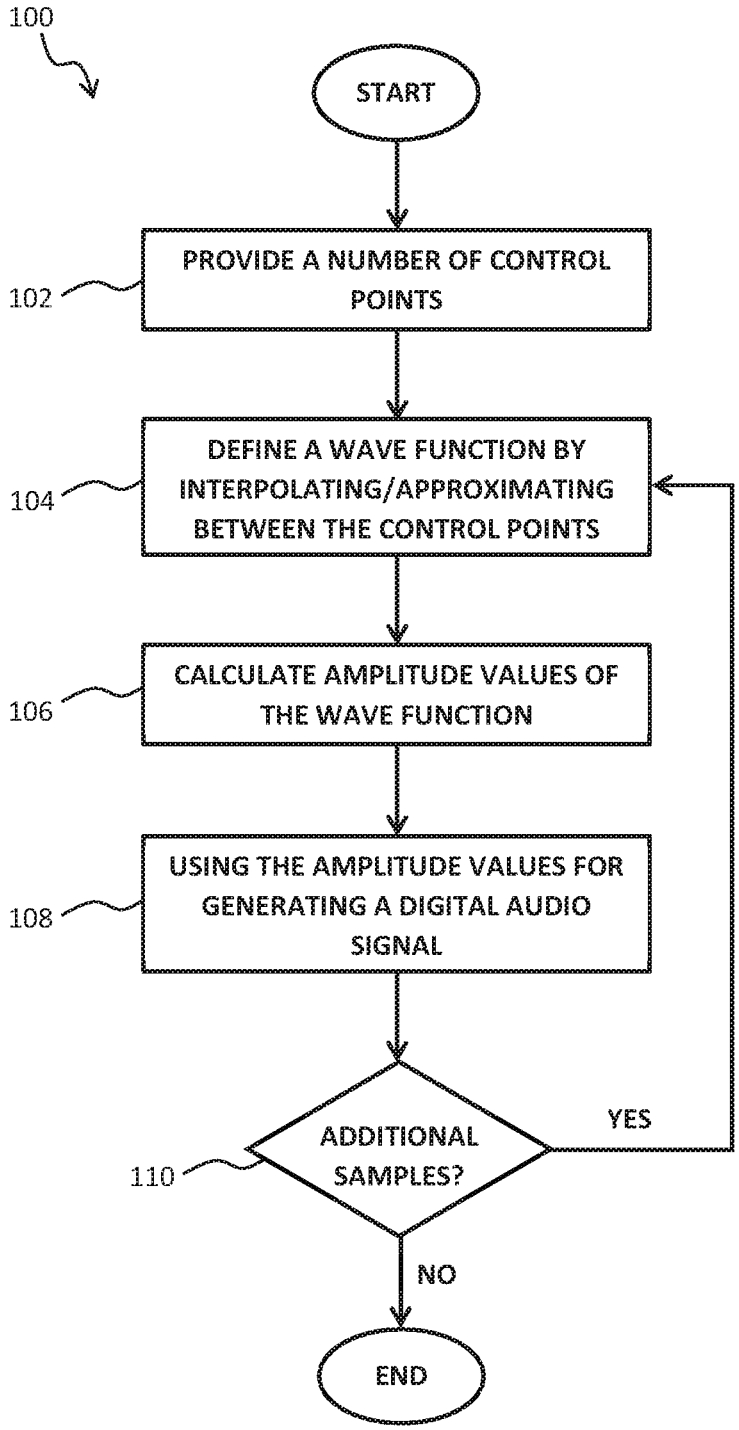
FIG. 10 is a flowchart of an exemplary method for synthetic generation of a digital audio signal.

FIG. 10 is a flowchart of an exemplary method 100 for synthetic generation of a digital audio signal. The method begins at Step 102 in which a number of control points are provided. Each control point may be given by an amplitude-period phase, a magnitude-frequency, or a phase-frequency value pair. The control points are changeable by respective associated control signals. The method continues by repeatedly performing, on the basis of the control points, the steps of defining a wave function by interpolating or approximating between the control points at Step 104, calculating amplitude values of the wave function at Step 106, and using the amplitude values for generating the digital audio signal at Step 108. If additional samples are needed, the method 100 returns to Step 104. If no more samples are needed, the method 100 terminates.

LIST OF REFERENCE NUMBERS

1 Synthesizer
2 Central unit
4 Storage
10 Digital-analog transducer
12 Loudspeaker unit
20 Processing unit
22 Display unit
30 Amplitude line
32 Wave segment
34 Segment edge
36 Touching point

The invention claimed is:

1. A method for synthetic generation of a digital audio signal, the method comprising:

providing, by a synthesizer, a number of control points, each of which is given by an amplitude-period phase, a magnitude-frequency, or a phase-frequency value pair, wherein the control points are changeable by respective associated control signals; and on the basis of the control points, repeatedly performing, by the synthesizer, the further steps of:

defining a wave function by interpolating or approximating between the control points;

calculating amplitude values of the wave function; and using the amplitude values for generating the digital audio signal.

2. The method of claim 1, wherein the amplitude, magnitude, or phase values of the control points and period-phase or frequency values of the control points are each changeable by individually associated control signals, independently from each other.

3. The method of claim 2, wherein at least one other attribute of the control points is changeable by at least one other individually associated control signal, independently of at least one of the amplitude, magnitude, or phase values or the period-phase or frequency values of the control points.

4. The method of claim 1, wherein polynomial-based interpolation, Bézier curves, b-splines, or NURBS are used for approximation or interpolation of a course between the control points, the basic conditions of the interpolation method being adapted when at least one of the control points or their attributes change.

5. The method of claim 1, wherein:

the wave function is composed of a number of wave segments (32) which follow each other within a period phase or a frequency band and are each defined by a segment-specific linear combination of a number of basic functions, the wave segments (32) being connected at segment edges (34) thereof, via one of the control points each, with the respective adjacent wave segment (32);

for each wave segment (32), linear coefficients are determined with which the respective wave segment (32) has at its segment edges (34), within the framework of a local control point, predefinable changeable amplitude or magnitude or phase edge values; and the values of respective updated linear coefficients are determined for the respective wave segment (32) during the repeated calculation of the amplitude values of the wave function and are taken as a basis for the calculation of the amplitude values.

6. The method of claim 5, wherein for each wave segment (32), the linear coefficients are determined and taken as a basis for calculating the values in the subsequent calculation period, with which the respective wave segment (32) has on its segment edges (34) a predefinable, changeable edge gradient.

7. The method of claim 5, wherein polynomial functions are used as the basic functions.

8. The method of claim 1, wherein the wave function is composed of a number of wave segments (32) which succeed each other within a period phase or a frequency band and are each defined by a segment-specific linear combination of a number of basic functions and control points, the wave segments (32) being connected on segment edges (34) thereof near one of the control points each with the respective adjacent wave segment (32) and the linear combination of the current control point with the basic functions assigned thereto being taken as a basis during the repeated calculation of the amplitude values of the wave function.

9. The method of claim 1, wherein the wave function is displayed on a display unit (22) for processing purposes.

10. The method of claim 1, wherein the control points are changed via an input device (20).

11. The method of claim 1, wherein the control points are temporally changed in accordance with a modulation function stored in a storage unit (4).

12. The method of claim 11, wherein:

the modulation function is generated by use of the repeatedly calculated amplitude values of the wave function that are determined by a period-phase or frequency-dependent amplitude course formed by the control points, the control points being formed by approximation or interpolation between a number of amplitude-period phase or amplitude-frequency value pairs over a predefined interval; and at least one of the parameter values or other attributes of the control points are changeable by respective associated control signals and the interpolation or approximation of the wave function determined by currently existing control signals is taken as a basis for the calculation of the amplitude values.

13. The method of claim 1, wherein at least two control signals which are independent of each other are provided.

14. The method of claim 7, wherein the polynomial functions are of the third degree.

* * * * *